US007712471B2

(12) United States Patent
Reddy et al.

(10) Patent No.: US 7,712,471 B2
(45) Date of Patent: May 11, 2010

(54) METHODS FOR FORMING TRANSITION METAL OXIDE CLUSTERS AND SMOKING ARTICLES COMPRISING TRANSITION METAL OXIDE CLUSTERS

(75) Inventors: Budda V. Reddy, Glen Allen, VA (US); Firooz Rasouli, Midlothian, VA (US); Mohammad R. Hajaligol, Midlothian, VA (US); Shiv N. Khanna, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 1432 days.

(21) Appl. No.: 11/077,554

(22) Filed: Mar. 11, 2005

(65) Prior Publication Data

US 2005/0263164 A1 Dec. 1, 2005

Related U.S. Application Data

(63) Continuation-in-part of application No. 10/972,206, filed on Oct. 25, 2004.

(60) Provisional application No. 60/514,554, filed on Oct. 27, 2003.

(51) Int. Cl.
*A24B 15/18* (2006.01)

(52) U.S. Cl. ..... 131/334; 502/316; 502/325; 502/326; 423/141; 423/632

(58) Field of Classification Search ..... None
See application file for complete search history.

(56) References Cited

U.S. PATENT DOCUMENTS 3,313,306 A 4/1967 Berger et al.
3,720,214 A 3/1973 Norman et al.
3,807,416 A 4/1974 Hedge et al.
3,931,824 A 1/1976 Miano et al.
4,108,151 A 8/1978 Martin et al.
4,109,663 A 8/1978 Maeda et al.
4,119,104 A 10/1978 Roth
4,182,348 A 1/1980 Seehofer et al.
4,193,412 A 3/1980 Heim et al.

(Continued)

FOREIGN PATENT DOCUMENTS

EP 0499402 A1 8/1992

(Continued)

OTHER PUBLICATIONS

Matsui, et al., "Hydrothermal Synthesis of Nano-Sized Iron Oxide Crystals in the Cavity of Carbon Nanotubes," 2002, Taylor and Francis Ltd., Molecular Crystals and Liquid Crystals, vol. 387, pp. 225-229.*

(Continued)

*Primary Examiner*—Philip C Tucker
*Assistant Examiner*—Michael J Felton
(74) *Attorney, Agent, or Firm*—Buchanan Ingersoll & Rooney PC

(57) ABSTRACT

Smoking article components, cigarettes, methods for making cigarettes and methods for smoking cigarettes are provided that use transition metal oxide clusters capable of catalyzing and/or oxidizing the conversion of carbon monoxide to carbon dioxide and/or adsorbing carbon monoxide. Cut filler compositions, cigarette paper and cigarette filter material can comprise transition metal oxide clusters.

5 Claims, 5 Drawing Sheets

U.S. PATENT DOCUMENTS

| | | | |
|---|---|---|---|
| 4,195,645 | A | 4/1980 | Bradley, Jr. et al. |
| 4,197,861 | A | 4/1980 | Keith |
| 4,421,862 | A | 12/1983 | Bradley |
| 4,450,847 | A | 5/1984 | Owens |
| 4,453,553 | A | 6/1984 | Cohn |
| 4,489,739 | A | 12/1984 | Mattina, Jr. et al. |
| 4,744,374 | A | 5/1988 | Deffeves et al. |
| 4,788,308 | A | 11/1988 | Siedle |
| 5,101,839 | A | 4/1992 | Jakob et al. |
| 5,105,836 | A | 4/1992 | Gentry et al. |
| 5,129,408 | A | 7/1992 | Jakob et al. |
| 5,211,684 | A | 5/1993 | Shannon et al. |
| 5,284,166 | A | 2/1994 | Cartwright et al. |
| 5,306,683 | A | 4/1994 | Maroni et al. |
| 5,322,075 | A | 6/1994 | Deevi et al. |
| 5,386,838 | A | 2/1995 | Quincy, III et al. |
| 5,500,198 | A | 3/1996 | Liu et al. |
| 5,591,368 | A | 1/1997 | Fleischhauer et al. |
| 5,598,868 | A | 2/1997 | Jakob et al. |
| 5,671,758 | A | 9/1997 | Rongved |
| 5,728,462 | A | 3/1998 | Arino et al. |
| 5,759,949 | A | 6/1998 | Grigorova et al. |
| 5,925,590 | A | 7/1999 | White et al. |
| 5,934,289 | A | 8/1999 | Watkins et al. |
| 6,053,176 | A | 4/2000 | Adams et al. |
| 6,095,152 | A | 8/2000 | Beven et al. |
| 6,138,684 | A | 10/2000 | Yamazaki et al. |
| 6,183,717 | B1 | 2/2001 | Khan |
| 6,286,516 | B1 | 9/2001 | Bowen et al. |
| 6,371,127 | B1 | 4/2002 | Snaidr et al. |
| 2002/0002979 | A1 | 1/2002 | Bowen et al. |
| 2002/0062834 | A1 | 5/2002 | Snaidr et al. |
| 2002/0114746 | A1 | 8/2002 | Roark et al. |
| 2003/0037792 | A1 | 2/2003 | Snaidr et al. |
| 2003/0145681 | A1 | 8/2003 | El-Shall et al. |

FOREIGN PATENT DOCUMENTS

| | | |
|---|---|---|
| GB | 1104993 | 3/1968 |
| WO | 87/06104 | 10/1987 |
| WO | 98/51401 | 11/1998 |
| WO | 00/09259 | 2/1999 |
| WO | 99/16546 | 4/1999 |
| WO | 99/21652 | 5/1999 |
| WO | 00/40104 | 7/2000 |
| WO | 02/24005 | 3/2002 |

OTHER PUBLICATIONS

Kim, et al., Solvothermal Synthesis of Tungsten Oxide Nanorod/Nanowire/Nanosheet, Journal of the American Ceramic Society, 2005, vol. 88, No. 6, pp. 1684-1686.*

Y. Xie, W. Z. Wang, Y. T. Qian, X. M. Liu, Solvothermal Route to Nanocrystalline CdSe, Journal of Solid State Chemistry, vol. 147, Issue 1, Oct. 1999, pp. 82-84, ISSN 0022-4596, DOI: 10.1006/jssc.1999.8179. (http://www.sciencedirect.com/science/article/B6WM2-45FKVTD-42/2/5592cbb8624119740760f91449ac0977).*

International Preliminary Report on Patentability for PCT/IB2004/003633 dated May 1, 2006.

Katz, J. L., "Condensation of a Supersaturated Vapor. I. The Homogeneous Nucleation of the *n*-Alkanes", *The Journal of Chemical Physics*, vol. 52, No. 9, May 1, 1970, pp. 4733-4748.

Rosén, A., "A Periodic Table In Three DImensions: A Sightseeing Tour in the Nanometer World", *Advances in Quantum Chemistry*, vol. 30, 1998, Göteborg, Sweden, pp. 235-265.

Rosén, A., "A Sightseeing tour in the world of clusters-serendipity and scientific progress", *Journal of Molecular Graphics and Modelling*, vol. 19, No. 2, 2001, pp. 236-243, New York, NY.

Cox, A. J. et al., "Experimental Observation of Magnetism in Rhodium Clusters", *Physical Review Letters*, vol. 71, No. 6, Aug. 9, 1993, pp. 923-926.

Reddy, B. V. et al., "Giant Magnetic Moments in 4*d* Clusters", *Physical Review Letters*, vol. 70, No. 21, May 24, 1993, pp. 3323-3326.

Pederson, M. R. et al., "Variational mesh For quantum-mechanical simulations", *Physical Review B*, vol. 41, No. 11, Apr. 15, 1990, pp. 7453-7461.

Jackson, K. et al. "Accurate forces in a local-orbital approach to the local-density approximation", *Physical Review B*, vol. 41, No. 6, Aug. 15, 1990, pp. 3276-3281.

Porezag, D. et al., "Optimization of Gaussian Basis Sets for Density-Functional Calculations", *Physical Review A*, vol. 60, No. 4, Oct. 1999, pp. 2840-2847.

International Search Report and Written Opinion dated Aug. 19, 2005 for PCT/IB2004/003633.

Tang et al., "Solvothermal Route to Semiconductor Nanowires," *Adv. Meter.*, 15(2003), pp. 448-450.

Wang et al., "Synthesis and Characterization of MSe Nanorods by a New Solvothermal Method," *Inorg. Chem. Commun.*, 2(3), pp. 83-85 (1999).

Dai et al., "Synthesis and characterization of carbide nanorods," *Nature*, 375, pp. 769-772 (1995).

* cited by examiner

| Neutral | A. E. | I. P. | E. A. | V. D. E. |
|---|---|---|---|---|
|   M = 5 | 5.53 | 8.82 | 1.25 (1.50) |   |
|   M = 1 | 14.64 | 7.46 | 1.31 (1.36) |   |
|   M = 5 | 24.61 | 7.59 | 2.17 (2.20) |   |
|   M = 1 | 34.33 | 7.39 | 2.54 (2.70) |   |
|   M = 5 | 43.13 | 7.60 | 2.63 |   |

METHODS FOR FORMING TRANSITION METAL OXIDE CLUSTERS AND SMOKING ARTICLES COMPRISING TRANSITION METAL OXIDE CLUSTERS

CROSS-REFERENCE TO RELATED APPLICATIONS

The present application is a continuation-in-part of U.S. patent application Ser. No. 10/972,206 filed on Oct. 25, 2004 which claims priority under 35 U.S.C. §119 to U.S. Provisional Patent Application No. 60/514,554 filed on Oct. 27, 2003, the entire content of each is hereby incorporated by reference.

BACKGROUND

Smoking articles, such as cigarettes or cigars, produce both mainstream smoke during a puff and sidestream smoke during static burning. One constituent of both mainstream smoke and sidestream smoke is carbon monoxide (CO). The reduction of carbon monoxide in smoke is desirable.

Despite the developments to date, there remains an interest in improved and more efficient methods and compositions for reducing the amount of carbon monoxide in the mainstream smoke of a cigarette during smoking.

SUMMARY

Disclosed is a component of a smoking article comprising clusters of transition metal oxides, wherein the component is selected from the group consisting of tobacco cut filler, cigarette paper and cigarette filter material. Also disclosed is a cigarette comprising a tobacco rod, cigarette paper and an optional filter, wherein at least one of the tobacco rod, cigarette paper and optional filter comprise clusters of transition metal oxides.

The transition metal oxide clusters can comprise one or more oxides of the group of transition metals consisting of scandium, titanium, vanadium, chromium, manganese, iron, cobalt, nickel, copper and mixtures thereof. Preferably the transition metal oxide clusters consist of oxygen and the transition metal. Preferred oxide clusters are $Fe_2O_2$ and $Fe_2O_3$.

The clusters are capable of catalyzing and/or oxidizing the conversion of carbon monoxide to carbon dioxide and/or adsorbing carbon monoxide. For example, the clusters are capable of catalyzing and/or oxidizing the conversion of carbon monoxide by donating oxygen atoms to the carbon monoxide, wherein the clusters have the general formula $M_xO_y$ ($y>x$). Also, the clusters are capable of catalyzing and/or oxidizing the conversion of carbon monoxide in the presence of an external source of oxygen, wherein the clusters have the general formula $M_xO_y$ ($y \leqq x$).

The clusters can be incorporated into a smoking article component and/or into a cigarette in an amount effective to reduce the ratio in mainstream smoke of carbon monoxide to total particulate matter by at least about 10%.

The clusters can have a mean particle size of less than about 2 nm or less than about 1 nm, and can comprise fewer than about 2,500 atoms or fewer than about 1,000 atoms. In an embodiment the clusters are charge neutral.

The clusters can be supported on support particles. The support particles can be selected from the group consisting of silica gel beads, activated carbon, molecular sieves, magnesia, alumina, silica, titania, zirconia, iron oxide, cobalt oxide, nickel oxide, copper oxide, yttria optionally doped with zirconium, manganese oxide optionally doped with palladium, ceria and mixtures thereof. Preferred support particles comprise nanoscale particles.

Also provided is a method for incorporating transition metal oxide clusters in and/or on a component of a smoking article comprising (i) supporting the component in a chamber having a target; (ii) bombarding the target with energetic ions to form transition metal oxide clusters; and (iii) depositing the transition metal oxide clusters on a surface of the component in order to incorporate the transition metal oxide clusters in and/or on the component, wherein the component is selected from the group consisting of tobacco cut filler, cigarette paper and cigarette filter material.

Supported transition metal oxide clusters can be formed by bombarding a target comprising at least first and second transition metal elements. Transition metal oxide clusters comprising the first metallic element can be formed that are supported on support particles comprising the second metallic element. The supported transition metal oxide clusters can be collected and incorporated in and/or on a component of a smoking article or the supported transition metal oxide clusters can be formed and directly incorporated in and/or on a component of a smoking article that is provided within the chamber during the bombardment.

The chamber can comprise a vacuum chamber and the pressure inside the chamber during the bombarding can be greater than about $1\times10^{-4}$ Torr. In an embodiment, the pressure inside the chamber is about atmospheric pressure. During the bombarding of the target the atmosphere in the chamber can comprise an inert gas or an oxidizing gas. For example, the atmosphere can comprise argon and/or an oxidizing gas such as oxygen. In addition to oxygen, suitable oxidizing gases include CO, $CO_2$, NO, $H_2O$ or mixtures thereof.

The component can be supported during the bombardment on a substrate holder having a temperature of from about −196° C. to 100° C. The component can be supported at a distance of from about 2 to 20 cm from the target.

In a preferred embodiment the target is bombarded with a laser to produce the transition metal oxide clusters. In a further embodiment, the target is subjected to radio frequency sputtering or magnetron sputtering to produce the transition metal oxide clusters. The clusters preferably form in the gas phase.

A further preferred embodiment provides a method of making a cigarette, comprising (i) incorporating transition metal oxide clusters in and/or on a component of a cigarette selected from the group consisting of tobacco cut filler, cigarette paper and cigarette filter material; (ii) providing the tobacco cut filler to a cigarette making machine to form a tobacco column; (iii) placing the cigarette paper around the tobacco column to form a tobacco rod of a cigarette, and (iv) optionally tipping the tobacco rod with a cigarette filter comprising the cigarette filter material.

An additional embodiment relates to a method for incorporating transition metal oxide clusters in and/or on a component of a smoking article comprising spraying, dusting and/or mixing the transition metal oxide clusters with the component.

A method of smoking a cigarette is provided comprising lighting the cigarette to form smoke and drawing the smoke through the cigarette, wherein during the smoking of the cigarette, transition metal oxide clusters adsorb carbon dioxide and/or convert carbon monoxide to carbon dioxide via oxidation and/or catalysis. During the smoking of the cigarette the oxidation state of the transition metal oxide clusters can continuously change.

DETAILED DESCRIPTION OF PREFERRED EMBODIMENTS

Smoking article components (e.g., tobacco cut filler, cigarette paper and cigarette filter material), smoking articles (e.g., cigarettes), methods for making cigarettes and methods for smoking cigarettes are provided that use transition metal oxide clusters. The transition metal oxide clusters, which are incorporated in and/or on the smoking article component(s), can adsorb carbon monoxide and/or convert carbon monoxide to carbon dioxide.

Transition metal oxide clusters can be represented by the general formula $M_xO_y$,(x>0; y>0) where M represents at least one transition metal selected from the group consisting of Sc, Ti, V, Cr, Mn, Fe, Co, Ni and Cu, and O is oxygen. A cluster can be characterized as an assembly of atoms that are bonded together. Transition metal oxide clusters comprise from four to a few thousand atoms. For example, the clusters can comprise fewer than about 2,500 atoms, e.g., fewer than about 2,000; 1,500; 1,000; 750; 500; 250; 100; 50 or 10 atoms. Transition metal oxide clusters have an average particle size of less than about 3 nm, e.g., less than about 2.5, 2 or 1.5 nm.

Transition metal oxide clusters can comprise one or more different transition metal elements. The metallic elements can comprise the same or different oxidation states. Thus, mixed transition metal oxide clusters can comprise different chemical entities (e.g., a mixture of $Fe_2O_3$ clusters and CuO clusters) or different forms of the same metal oxide (e.g., a mixture of $Fe_2O_3$ and $Fe_2O_2$ clusters).

Without wishing to be bound by theory, transition metal oxide clusters can enhance the conversion of carbon monoxide to carbon dioxide on account of their high surface area to volume ratio, flexible geometric structure and multiplicity of oxidation states. Transition metal oxide clusters may affect charge distribution and the breaking of localized bonds in both carbon monoxide and oxygen.

Transition metal oxide clusters can facilitate the conversion of carbon monoxide to carbon dioxide in either the absence or presence of an external source of oxygen. An external source of oxygen is oxygen from the gas phase. An internal source of oxygen is oxygen from the solid state, i.e., from the cluster lattice. For instance, transition metal oxide clusters of the type $M_xO_y$ (y>x) can enhance the conversion of carbon monoxide to carbon dioxide in an oxygen-poor environment by donating oxygen atoms from the cluster lattice to the carbon monoxide. The cluster is an oxidant (i.e., the cluster is itself reduced) when the cluster donates a lattice oxygen from the cluster to a carbon monoxide molecule. In a further example, transition metal oxide clusters of the type $M_xO_y$ ($y \leqq x$) can enhance the conversion of carbon monoxide to carbon dioxide in the presence of an external source of oxygen. In the presence of oxygen it is believed that the conversion of carbon monoxide proceeds via CO adsorption and subsequent oxidation.

Figure 1A:
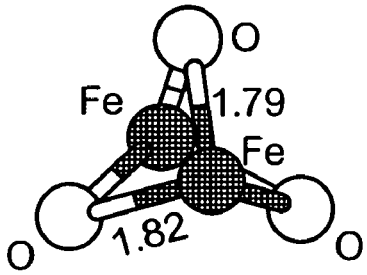
FIG. 1A is an illustration of the ground state geometry of an $Fe_2O_3$ cluster.

A transition metal oxide cluster having the formula $M_xO_y$ (y>x) is referred to as an oxygen-rich or Type A cluster. Examples of Type A clusters in the iron oxide system include $Fe_2O_3$, $Fe_3O_5$, $Fe_4O_6$, $Fe_4O_5$, $Fe_5O_6$, $Fe_5O_7$, $Fe_6O_8$, $Fe_7O_9$ and $Fe_8O_{10}$. A schematic illustration of the ground state geometry of an $Fe_2O_3$ cluster is shown in FIG. 1A. The ground state geometry of a $Fe_2O_3$ cluster is a distorted triangular bipyramid.

Figure 1B:
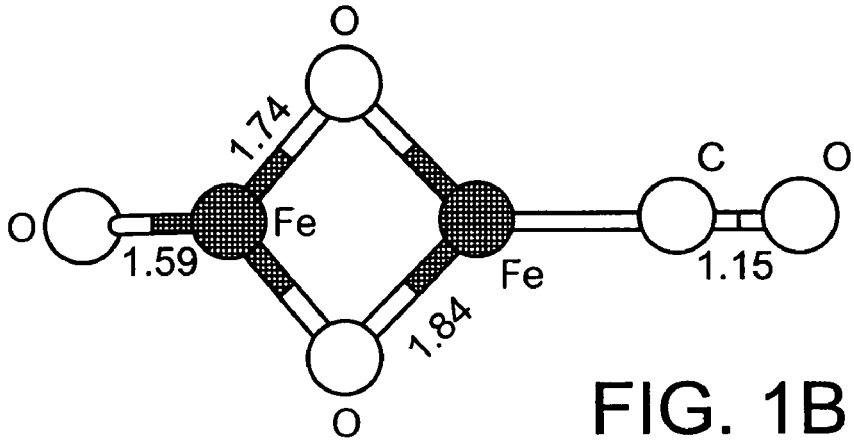
FIG. 1B is an illustration of the ground state geometry of an $Fe_2O_3$—CO cluster.

Type A clusters such as $Fe_2O_3$ can undergo a geometric distortion upon initial adsorption of a CO molecule. This distortion can occur in the presence of an external source of oxygen. The ground state geometry of a distorted $Fe_2O_3$—CO cluster is shown in FIG. 1B. The distortion involves the breaking of a metal-oxygen bond via the adsorption of a CO molecule. The metal-oxygen bond scission creates an unsaturated oxygen atom in a favorable path of access for a subsequent CO molecule. The subsequent CO molecule can be oxidized by the unsaturated oxygen atom. The $Fe_2O_3$ cluster can oxidize CO to $CO_2$ by donating a lattice oxygen from the cluster. Thus, in the reaction between a Type A cluster and CO the Type A cluster can be reduced to form a Type B cluster.

Figure 2A:
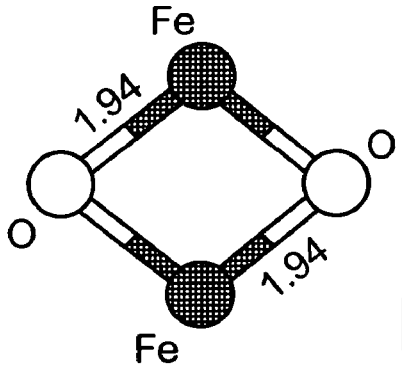
FIG. 2A is an illustration of the ground state geometry of an $Fe_2O_2$ cluster.
Figure 2B:
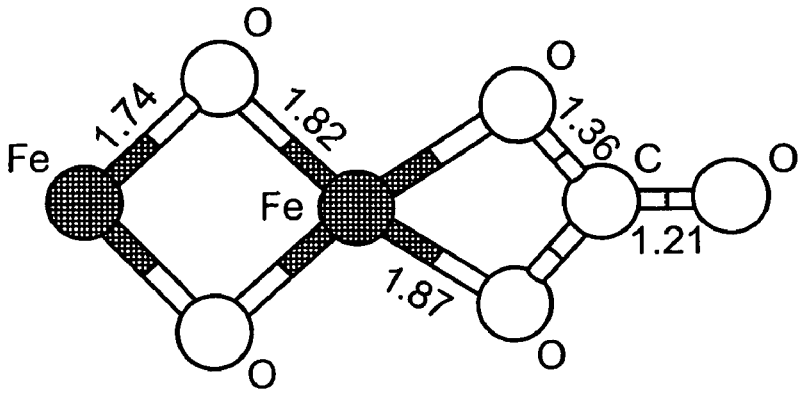
FIG. 2B is an illustration of the ground state geometry of an $Fe_2O_2$—$CO_3$ complex.

A transition metal oxide cluster having the formula $M_xO_y$ ($y \leqq x$) is referred to as an oxygen-poor or Type B cluster. Examples of Type B clusters in the iron oxide system include $Fe_2O$, $Fe_2O_2$, $Fe_3O_2$, $Fe_3O_3$, $Fe_4O_3$, $Fe_4O_4$, $Fe_5O_4$, $Fe_5O_5$. A schematic illustration of the ground state geometry of a $Fe_2O_2$ cluster is shown in FIG. 2A. The ground state geometry of a $Fe_2O_2$ cluster is a distorted rhombus. In the presence of an external source of oxygen, Type B clusters such as $Fe_2O_2$ can adsorb CO molecules and, via the formation of a $CO_3$ intermediate, desorb a $CO_2$ molecule. The structure of a Type B ($Fe_2O_2$) cluster complexed with $CO_3$ is shown in FIG. 2B. The oxidation of CO by $Fe_2O_2$ can form $Fe_2O_3$ according to the general equation $Fe_2O_2+3CO+2O_2 \rightarrow Fe_2O_3+3CO_2$. Thus, the reaction between a Type B cluster and CO can oxidize the Type B cluster to form a Type A cluster. The initial CO adsorption by a Type A cluster can form active catalytic sites within the cluster that can be continuously regenerated to sustain catalytic conversion and/or oxidation of carbon monoxide. Furthermore, in the absence of an external source of oxygen Type B clusters can adsorb a CO molecule.

Density functional theory can be used to describe the ground state properties of transition metal oxide clusters. Density functional theory (DFT) is a general approach to the ab initio description of quantum many-particle systems, in which the original many-body problem is recast in the form of an auxiliary single-particle problem. In most cases, DFT is based on the fact that any ground state observable (e.g., ground state energy) is uniquely determined by the corresponding ground state density. Thus, the effects of particle-particle interactions can be represented as a density-dependent single-particle potential.

The equilibrium structures of metal oxide clusters can be determined using density functional theory. Moreover, growth mechanisms and stability patterns can be derived. Furthermore, while results for iron oxide clusters are described herein, it is believed that the theoretical observations are applicable to other transition metal oxides (as well as mixed oxides) including the oxides of scandium, titanium, vanadium, chromium, manganese, cobalt, nickel, copper, zinc, yttrium, zirconium, niobium, molybdenum, rhodium, palladium, silver, cerium, hafnium, tantalum, tungsten, rhenium, iridium and mixtures thereof.

In the example of iron oxide, DFT calculations reveal that the transition from elementary iron oxide (i.e., $Fe_1O_1$) to bulk iron oxide (i.e., FeO) proceeds via hollow rings, towers and drums. Electronic structure calculations carried out within a gradient-corrected density functional framework show that small iron oxide clusters having the formula $Fe_nO_n$ ($n \leqq 5$) form single, stable rings, and that larger structures comprise these rings as stable building blocks. For example, $Fe_nO_n$ clusters comprising six or more iron atoms comprise a substantially vertical assemblage of rings that are stacked into columnar, tower-like structures wherein adjoining rings are weakly bonded to their neighbors. The $Fe_6O_6$ cluster, for example, is formed from two stacked $Fe_3O_3$ rings; the $Fe_9O_9$ cluster is formed from three stacked $Fe_3O_3$ rings; and the $Fe_{12}O_{12}$ cluster consists of four $Fe_3O_3$ rings or three $Fe_4O_4$ rings that are stacked one upon another. In the example of the $Fe_{12}O_{12}$ cluster, the energy of the structure comprising three $Fe_4O_4$ rings is about 0.01 eV higher than the energy of the structure comprising four $Fe_3O_3$ rings. Because this energy difference is outside of the limit of the theoretical studies, the two structures can be considered degenerate.

According to an embodiment, the rings and towers can be stabilized via the addition of one or more atoms of oxygen. With respect to a ring or tower having the formula $Fe_nO_n$, the addition of one or two oxygen atoms forms $Fe_nO_{n+1}$ and $Fe_nO_{n+2}$ sequences, respectively. Moreover, the binding energy of added oxygen atoms continuously increases as n increases such that the binding energy of the 'stabilizing' oxygen becomes comparable to the binding energy of 'lattice' oxygen (i.e., oxygen within a tower) at $n \geqq 12$.

DFT calculations are performed using the NRLMOL set of codes disclosed by Pederson, et al. (See, e.g., M. R. Pederson and K. A. Jackson, Phys. Rev. B 41, 7453 (1990); K. A. Jackson and M. R. Pederson, Phys. Rev. B 42, 3276 (1990); and D. V. Porezag and M. R. Pederson, Phys. Rev. A 60, 2840 (1999)). The codes assume a linear combination of atomic orbitals and use local and gradient-corrected functionals to incorporate exchange and correlation effects. For a given cluster of atoms, the electronic wave function is constructed from a linear combination of atomic orbitals that are expressed as linear combinations of Gaussian wavefunctions centered at the atomic locations. The matrix elements of the Hamiltonian are computed via numerical integration over a chosen web of points. The basis set for iron consists of 7 s, 5 p and 4 d functions constructed from 20 bare Gaussians, and the basis set for oxygen consists of 5 s, 4 p and 3 d functions constructed from 13 bare Gaussians. The basis sets are supplemented by a 1 d Gaussian.

Several starting configurations can be used to determine the ground state for a given cluster. For each starting configuration, the geometry can be optimized by calculating the Hellmann-Feynman forces until the forces are less than a threshold value of 0.001 Hartree/Bohr. For iron oxide, the ground state of the oxidized cluster can correspond to both ferromagnetic and anti-ferromagnetic configurations. Thus, in addition to the geometrical arrangements, several possible ferrimagnetic states can be considered. A ferrimagnetic interaction is a specific type of antiferromagnetic interaction in which the net spin of the system is not equal to zero due to the spin in each direction not being equal, and therefore not cancelling. Due to computing limitations, calculations were performed only up to n=13 (i.e., up to $Fe_{13}O_{13}$).

Figure 3:
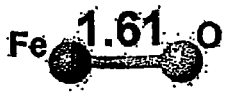
FIG. 3 shows the ground state geometries, bond lengths, atomization energies, ionization potentials, electron affinities, multiplicity, and vertical transition energies from the anion to neutral cluster transition for $Fe_nO_n$ (n=1 to 5) clusters.
Figure 3:
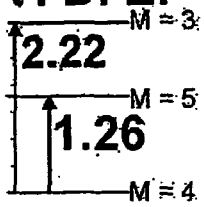
Figure 3:
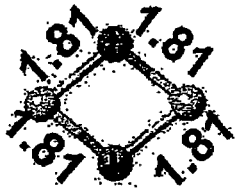
Figure 3:
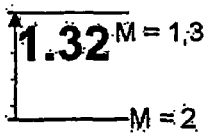
Figure 3:
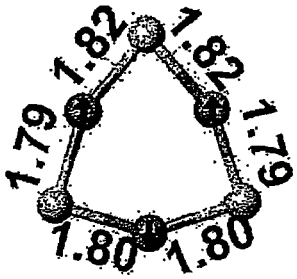
Figure 3:
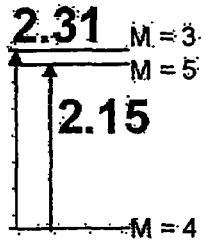
Figure 3:
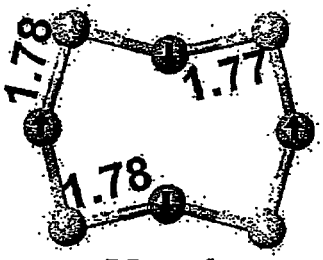
Figure 3:
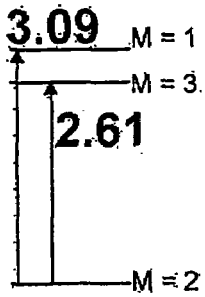
Figure 3:
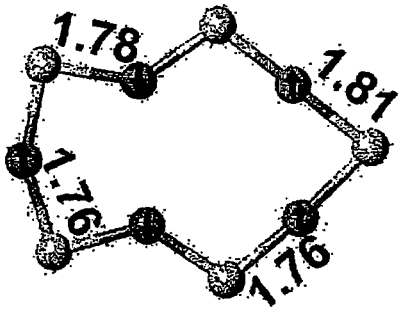
Figure 3:
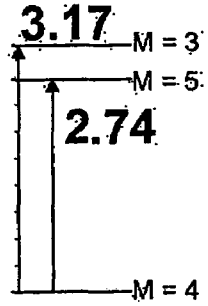

FIG. 3 shows the ground state geometries and local spin moments for $Fe_nO_n$ clusters for n=1 to 5. The ground state structures are all open rings. In FIG. 3, the dark circles correspond to iron atoms and the lighter circles correspond to oxygen atoms. The ground state for small iron oxide clusters is ferrimagnetic, however the difference between the ferrimagnetic binding energy per atom and the ferromagnetic state is less than 0.1 eV. Also shown in FIG. 3 are the atomization energies (AE), which can be calculated from the equation: $AE = n\,E(Fe) + m\,E(O) - E(Fe_nO_m)$, where E(Fe) and E(O) are the total energies of the Fe and O atoms, and $E(Fe_nO_m)$ is the total energy of the cluster. The atomization energy is the energy required to break a cluster into its constituent atoms. For anionic clusters, the energy is calculated for breaking the cluster into neutral Fe atoms and $O^-$ anions. For iron oxide (FeO), the calculated bond lengths, atomization energy, ionization potential and adiabatic electron affinity are calculated to be 1.61 A, 5.53 eV, 8.82 eV and 1.25 eV, respectively, which are in good agreement with literature values obtained from experimental data.

The results of the theoretical calculations can be correlated to negative ion photoelectron spectra. In negative ion photoelectron spectroscopy, a fixed frequency photon beam (e.g., a laser) is used to eject an electron from an anionic cluster. The energy required to transform the anionic cluster to the neutral cluster can be determined from the difference in energy of the kinetic energy of the detached electron and the corresponding photon.

For an anionic cluster having a spin multiplicity of M, the spin multiplicity of the corresponding neutral cluster will be M±1 because the ejected anion could originate in a spin up or a spin down configuration. The neutral cluster can be in the ground state or in an excited state. Generally, however, the transitions are vertical from the anion ground state to electronically excited states of the neutral, wherein the neutral has the same geometry as the anion. Adiabatic electron affinities can be calculated from photoelectron spectra and used to predict cluster geometry. In FIG. 3, the experimental data are shown in parentheses along with vertical detachment energies (VDE) corresponding to the possible electronic transitions. The negative ion photoelectron data are in good agreement with the theoretical calculations.

The stability of the primary rings may be evidenced by the fragmentation patterns of clusters. For example, when a cluster is fragmented into its constituent components, the minimum energy calculated to effect the fragmentation corresponds to the path that generates the most stable products. Thus, favored fragmentation products provide indirect evidence of stability. As evidence of the stability of small iron oxide rings, when iron oxide clusters are exposed to a 118 nm laser pulse (5.0 mJ/pulse), the surviving species correspond to $Fe_nO_n$ where n=2, 3 and 5.

Figure 4:
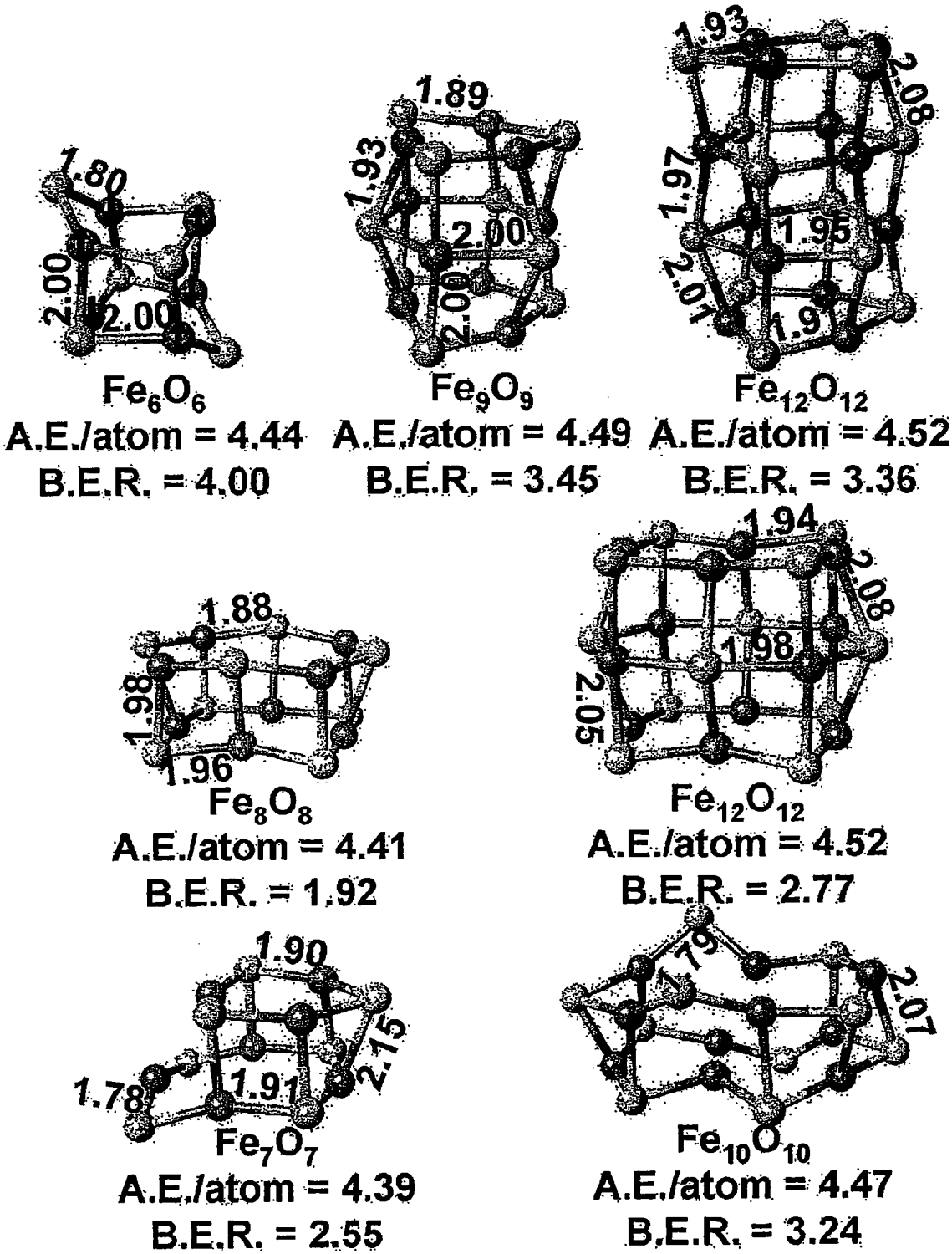
FIG. 4 shows the ground state geometries, atomization energies, and inter-ring binding energy for neutral $Fe_nO_n$ (n=6 to 10 and 12) clusters.

FIG. 4 shows the ground state geometries for $Fe_nO_n$ clusters for n=6 to 11 and 12. As discussed above, the clusters corresponding to n>5 comprise towers constructed of stable rings. The binding energy between the rings (BER) is also shown in FIG. 4. A value for the binding energy between the rings can be calculated from the expression $BER = [x\,E(Fe_mO_m) - E(Fe_nO_n)]/(x-1)$, where x is the number of rings of size m in a cluster of size n. A comparison of the binding energy in free rings with the BER indicates that the intra ring interactions are stronger than the inter ring interactions. Furthermore, consistent with the earlier observation that the free rings are stable building blocks, the bond lengths in a free ring of a given size are similar to the bond lengths in a corresponding ring that constitutes a tower or pillar structure (i.e., the rings undergo minimal deformation upon incorporation into a tower structure).

Figure 5:
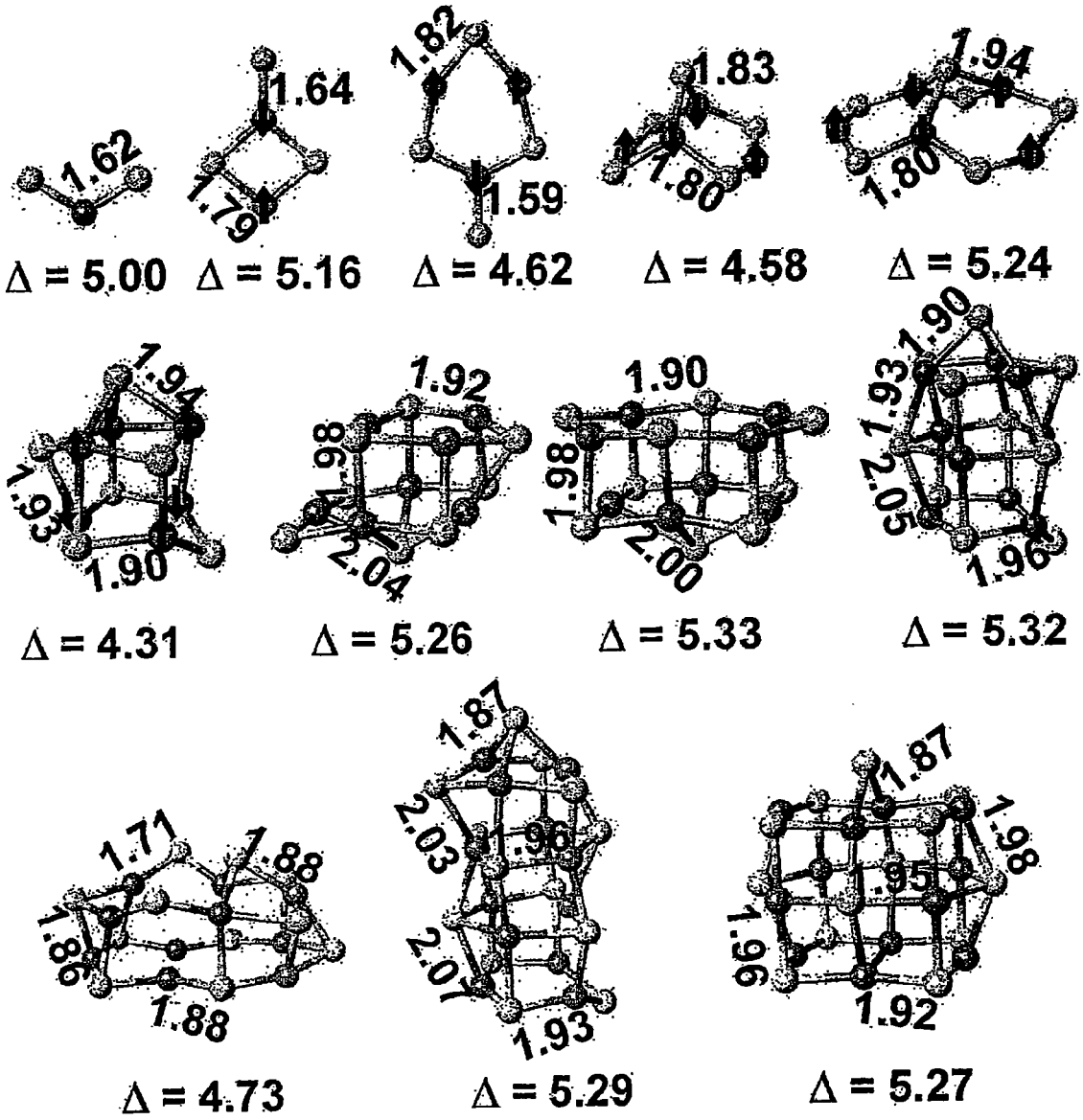
FIG. 5 shows the ground state geometries, bond lengths, and binding energies for O-stabilized $Fe_nO_{n+1}$ clusters (n=1 to 10 and 12).

The ground state geometries for rings and towers stabilized via the addition of atomic oxygen are shown in FIG. 5. In the cases of $Fe_2O_3$ and $Fe_3O_4$ clusters, the lowest energy configuration is obtained via the addition of an oxygen atom outside of the $Fe_2O_2$ or $Fe_3O_3$ central ring. In contract, the ground state of $Fe_4O_5$ and $Fe_5O_6$ comprise an oxygen atom inserted within the central ring. Also shown in FIG. 5 is the gain in binding energy, Δ, associated with the additional oxygen.

Still referring to FIG. 5, the stable structure for $Fe_nO_n$ (n>3) is achieved by adding atomic oxygen along the axis of the tower (i.e., within the ring. Stabilized towers of the formula $Fe_nO_{n+1}$ comprise a single stabilizing oxygen atom, and stabilized towers of the formula $Fe_nO_{n+2}$ comprise an oxygen atom at each end of the tower, forming a caged structure.

Solvothermal processes can be used to prepare iron oxide clusters (e.g., nanoscale clusters). Such processes may include solution-based self-assembly or structure-directing templating. Solvothermal processes may be performed at room temperature and pressure, however, elevated temperatures (e.g., greater than about 200° C. or greater than about 400° C.) and elevated pressures (e.g., greater than about 100 MPa or greater than about 200 MPa) are preferred. Suitable template materials may include carbon nanotubes, long chain alkyl amines or polymer molds and/or fibers. As a first example, one of the aforementioned template materials can be added to a solution comprising an organo-metallic precursor of iron dissolved in a suitable solvent (e.g., an organic solvent). After assembly of the precursor material on the template, which will occur due to van der Waals type intermolecular attraction between the precursor and template materials, the product can be dried and the template can be removed using chemical or thermal processing (e.g., a carbon template can be pyrolyzed in air). As a second example, nanoscale particles can be formed via laser ablation and 'soft deposition' of ablated species (e.g., iron oxide) on a suitable structure-directing template, followed by removal of the template. A method of forming nanoscale particles using laser vaporization is disclosed by commonly-owned U.S. Patent Application Publication No. 2003/0145681, which published Aug. 7, 2003, the entire contents of which are hereby incorporated by reference in its entirety.

As disclosed herein, metal oxide clusters may be used as catalysts for the conversion of carbon monoxide to carbon dioxide. The catalytic efficiency of metal oxide clusters may be enhanced by functionalizing the clusters. For example, clusters in the form of a ring or tower may accommodate (i.e., host) a second catalytically active species such as a metal atom, wherein the hosted metal atom is a different metal from the metal comprising the metal oxide cluster. Thus, nanoscale catalyst particles may comprise a heterogeneous, cluster-based composite catalyst. Using self-assembly and/or templating processes, stabilized or un-stabilized metal oxide clusters can be formed comprising, for example, one or more atoms of gold, platinum or other transition metal, or mixture of supported metal atoms, incorporated within the cluster (e.g., within the cage of a cluster tower).

While not wishing to be bound by theory, it is believed that oxygen atoms and electron transfer processes are involved in the oxidation reactions and that the transition metal oxide clusters can provide suitable surface sites for the chemisorption of carbon monoxide and may activate oxygen and/or facilitate atomic and electronic transfers. Thus, transition metal oxide clusters can serve as an oxygen activation and exchange medium during the catalysis and/or oxidation of carbon monoxide to carbon dioxide.

Transition metal oxide clusters such as iron oxide clusters can be incorporated into smoking articles such as cigarettes in order to reduce the concentration of carbon dioxide in the mainstream smoke of the smoking article. Aspects of incorporating transition metal oxide clusters into smoking article components are described below.

"Smoking" of a cigarette means the heating or combustion of the cigarette to form smoke, which can be drawn through the cigarette. Generally, smoking of a cigarette involves lighting one end of the cigarette and, while the tobacco contained therein undergoes a combustion reaction, drawing the cigarette smoke through the mouth end of the cigarette. The cigarette may also be smoked by other means. For example, the cigarette may be smoked by heating the cigarette and/or heating using electrical heater means, as described in commonly-assigned U.S. Pat. Nos. 6,053,176; 5,934,289; 5,591,368 or 5,322,075.

The term "mainstream" smoke refers to the mixture of gases passing down the tobacco rod and issuing through the filter end, i.e., the amount of smoke issuing or drawn from the mouth end of a cigarette during smoking of the cigarette. The mainstream smoke contains smoke that is drawn in through both the lighted region, as well as through the cigarette paper wrapper.

In addition to the constituents in the tobacco, the temperature and the oxygen concentration are factors affecting the formation and reaction of carbon monoxide and carbon dioxide. The total amount of carbon monoxide formed during smoking comes from a combination of three main sources: thermal decomposition (about 30%), combustion (about 36%) and reduction of carbon dioxide with carbonized tobacco (at least 23%). Formation of carbon monoxide from thermal decomposition, which is largely controlled by chemical kinetics, starts at a temperature of about 180° C. and finishes at about 1050° C. Formation of carbon monoxide and carbon dioxide during combustion is controlled largely by the diffusion of oxygen to the surface ($k_a$) and via a surface reaction ($k_b$). At 250° C., $k_a$ and $k_b$, are about the same. At about 400° C., the reaction becomes diffusion controlled. Finally, the reduction of carbon dioxide with carbonized tobacco or charcoal occurs at temperatures around 390° C. and above.

While not wishing to be bound by theory, it is believed that the transition metal oxide clusters can target the various reactions that occur in different regions of the cigarette during smoking. During smoking there are three distinct regions in a cigarette: the combustion zone, the pyrolysis/distillation zone, and the condensation/filtration zone.

First, the combustion zone is the burning zone of the cigarette produced during smoking of the cigarette, usually at the lighted end of the cigarette. The temperature in the combustion zone ranges from about 700° C. to about 950° C., and the heating rate can be as high as 500° C./second. Because oxygen is being consumed in the combustion of tobacco to produce carbon monoxide, carbon dioxide, water vapor, and various organic compounds, the concentration of oxygen is low in the combustion zone. The low oxygen concentrations coupled with the high temperature leads to the reduction of carbon dioxide to carbon monoxide by the carbonized tobacco. In this region, the transition metal oxide clusters can convert carbon monoxide to carbon dioxide via both catalysis and oxidation mechanisms. The combustion zone is highly exothermic and the heat generated is carried to the pyrolysis/distillation zone.

The pyrolysis zone is the region behind the combustion zone, where the temperatures range from about 200° C. to about 600° C. The pyrolysis zone is where most of the carbon monoxide is produced. The major reaction is the pyrolysis (i.e., thermal degradation) of the tobacco that produces carbon monoxide, carbon dioxide, smoke components, charcoal and/or carbon using the heat generated in the combustion zone. There is some oxygen present in this region, and thus the transition metal oxide clusters may act as a catalyst and/or oxidant for the conversion of carbon monoxide to carbon dioxide. The catalytic reaction begins at 150° C. and reaches maximum activity around 300° C. In the pyrolysis zone the transition metal oxide clusters can adsorb carbon monoxide.

Third, there is the condensation/filtration zone, where the temperature ranges from ambient to about 150° C. The major process in this zone is the condensation/filtration of the smoke components. Some amount of carbon monoxide and carbon dioxide diffuse out of the cigarette and some oxygen diffuses into the cigarette. The partial pressure of oxygen in the condensation/filtration zone does not generally recover to the atmospheric level. In the condensation/filtration zone carbon monoxide can be adsorbed by transition metal oxide clusters.

The transition metal oxide clusters may function as an adsorbent, catalyst and/or oxidant, depending upon the reaction conditions. Preferably, the clusters are capable of adsorbing carbon monoxide and catalyzing and/or oxidizing the conversion of carbon monoxide to carbon dioxide.

A catalyst is capable of affecting the rate of a chemical reaction, e.g., increasing the rate of oxidation of carbon monoxide to carbon dioxide without participating as a reactant or product of the reaction. An oxidant is capable of oxidizing a reactant, e.g., by donating oxygen to the reactant, such that the oxidant itself is reduced. An adsorbent is a substance that causes passing molecules or ions to adhere to its surface.

Transition metal oxide clusters, and optionally mixtures of different transition metal oxide clusters, can adsorb CO and catalyze and/or oxidize the conversion of CO to $CO_2$ in the same zone of a cigarette or in different zones of a cigarette. For example, $Fe_2O_3$ clusters can be incorporated throughout a cigarette rod and/or throughout cigarette paper. As a further example, a mixture of different clusters (e.g., $Fe_2O_3$ and $Fe_2O_2$) clusters can be incorporated throughout a cigarette rod and/or throughout cigarette paper. The $Fe_2O_3$ clusters can oxidize CO by donating an oxygen atom to CO and the $Fe_2O_2$ clusters can oxidize CO in the presence of an external source of oxygen. As noted above, the reaction between Type A clusters and CO can form Type B clusters, and the reaction between Type B clusters and CO can form Type A clusters. Thus, the conversion reactions can be self-sustaining. Throughout the conversion process the oxidation state of clusters participating in the conversion reactions can change continuously (e.g., a cluster can first be reduced, then oxidized, then reduced, etc., or a cluster can first be oxidized, then reduced, then oxidized, etc.).

In a preferred embodiment, the transition metal oxide clusters are provided in and/or on a support and supported transition metal oxide clusters are incorporated in and/or on a smoking article component. The support may include substantially any material that does not destroy the adsorptive, catalytic and/or oxidative properties of the transition metal oxide clusters.

The support can comprise inorganic oxide particles such as silica gel beads, molecular sieves, magnesia, alumina, silica, titania, zirconia, iron oxide, cobalt oxide, nickel oxide, copper oxide, yttria optionally doped with zirconium, manganese oxide optionally doped with palladium, ceria and mixtures thereof. The support, if used, is not particularly restricted and such conventional inorganic oxide supports such as silica and alumina, and a carbon support can be used without limitation. The support can comprise activated carbon particles, such as PICA carbon (PICA Carbon, Levallois, France). The support particles are preferably characterized by a BET surface area greater than about 20 $m^2/g$, e.g., 50 $m^2/g$ to 2,500 $m^2/g$, optionally with pores having a pore size greater than about 3 Angstroms, e.g., 10 Angstroms to 10 microns.

The support can comprise porous or non-porous particles. Pores with diameters less than 20 nm are commonly known as micropores; in activated carbon these micropores generally contain the largest portion of the carbon's surface area. Pores with diameters between 20 and 500 nm are known as mesopores, and pores with diameters greater than 500 nm are defined as macropores. The transition metal oxide clusters can be supported on an external surface of the support or within the channels and pores of a porous support such as porous ceramic materials. For example, the support can comprise porous granules and beads, which may or may not comprise interconnected passages that extend from one surface of the support to another.

A support can act as a separator, which can inhibit diffusion, agglomeration or sintering together of the transition metal oxide clusters before or during combustion of the cut filler and/or cigarette paper. Because a support can minimize cluster sintering, it can minimize the loss of active surface area of the transition metal oxide clusters. The transition metal oxide clusters can be chemically or physically bonded to the support.

Exemplary classes of porous ceramic materials that can be used as a support include molecular sieves such as natural or synthetic zeolites, microporous aluminum phosphates, silicoaluminum phosphates, silicoferrates, silicoborates, silicotitanates, magnesium aluminate spinels, zinc aluminates and mixtures thereof.

An example of a porous support is silica gel beads. Fuji-Silysia (Nakamura-ka, Japan) markets silica gel beads that range in size from about 5 to 30 microns and have a range of average pore diameters of from about 2.5 nm to 100 nm. The surface area of the silica gel beads ranges from about 30-800 $m^2/g$.

The support can comprise nanoscale particles. Nanoscale particles are a class of materials whose distinguishing feature is that their average diameter, particle or other structural domain size is below about 500 nanometers. Nanoscale support particles can have an average particle size less than about 100 nm, preferably less than about 50 nm, more preferably less than about 10 nm, and most preferably less than about 7 nm. The support may comprise catalytically active particles.

An example of a non-porous support is nanoscale iron oxide particles. For instance, MACH I, Inc., King of Prussia, Pa. sells $Fe_2O_3$ nanoscale particles under the trade names NANOCAT® Superfine Iron Oxide (SFIO) and NANOCAT® Magnetic Iron Oxide. The NANOCAT® Superfine Iron Oxide is amorphous ferric oxide in the form of a free flowing powder, with a particle size of about 3 nm, a specific surface area of about 250 $m^2/g$, and a bulk density of about 0.05 g/ml. The NANOCAT® Superfine Iron Oxide is synthesized by a vapor-phase process, which renders it free of impurities, and is suitable for use in food, drugs, and cosmetics. The NANOCAT® Magnetic Iron Oxide is a free flowing powder with a particle size of about 25 nm and a surface area of about 40 $m^2/g$. NANOCAT® Superfine Iron Oxide (SFIO) and NANOCAT® Magnetic Iron Oxide are preferred support particles for the transition metal oxide clusters.

Transition metal oxide clusters can be supported directly or indirectly by one or more different types of supports. For example, transition metal oxide clusters can be supported on nanoscale particles that can in turn be supported on larger support particles such as molecular sieves. The molecular sieves can act as a separator, which can inhibit agglomeration or sintering together of the nanoscale particles before or during combustion of the cut filler. Sintering of the nanoscale particles may elongate the combustion zone during combustion of the tobacco cut filler, which can result in excess carbon monoxide production.

Preferably, the selection of appropriate transition metal oxide clusters and optional support material(s) will take into account such factors as stability and preservation of activity during storage conditions, low cost and abundance of supply.

Transition metal oxide clusters may be incorporated in and/or on a support by various methods such impregnation or physical admixture. For example, the transition metal oxide clusters may be dispersed in a liquid, and a support may be mixed with the liquid having the dispersed transition metal oxide clusters. Transition metal oxide clusters dispersed in a liquid can be combined with a support using techniques such as spraying or dipping. After combining the support with the dispersed clusters, the liquid can be removed such as by evaporation so that the clusters remain on the support. The liquid may be substantially removed by heating the cluster-support mixture at a temperature higher than the boiling point of the liquid or by reducing the pressure of the atmosphere surrounding the cluster-support-mixture.

Substantially dry transition metal oxide clusters can be admixed with a support by dusting or via physical admixture. The transition metal oxide clusters can be chemically or physically bonded to an exposed surface of a support (e.g., an external surface of the support and/or a surface with a pore of cavity of the support).

A preferred support for transition metal oxide clusters is iron oxide particles. Iron oxide particle supported transition metal oxide clusters can be produced by physically admixing transition metal oxide clusters with iron oxide particles such as nanoscale iron oxide particles either in the presence or absence of a liquid.

In general, transition metal oxide clusters and a support can be combined in any suitable ratio to give a desired loading of transition metal oxide clusters on the support. Transition metal oxide clusters and support particles can be combined, for example, to produce from about 0.1 to 25% wt. %, e.g., at least 2 wt. %, at least 5 wt. %, at least 10 wt. % or at least 15 wt. % clusters on the support particles.

Supported or unsupported transition metal oxide clusters can be distributed either homogeneously or inhomogeneously along the cigarette paper and/or throughout the tobacco cut filler or cigarette filter material of a cigarette. For example, the transition metal oxide clusters can be incorporated along the entire length of a tobacco rod or the transition metal oxide clusters can be located at discrete locations along the length of a tobacco rod. By providing the transition metal oxide clusters along the cigarette paper and/or throughout the tobacco cut filler or cigarette filter material, it is possible to reduce the amount of carbon monoxide drawn through the cigarette, and particularly in both the combustion region and in the pyrolysis zone. The transition metal oxide clusters can be incorporated into the filter material used to form a cigarette filter. The transition metal oxide clusters are capable of adsorbing carbon monoxide and/or capable of acting as an oxidant for the conversion of carbon monoxide to carbon dioxide and/or as a catalyst for the conversion of carbon monoxide to carbon dioxide.

The transition metal oxide clusters, as described above, may be provided along the length of a tobacco rod by distributing the clusters on, or incorporating them into loose cut filler tobacco using any suitable method. The clusters may also be added to the cut filler tobacco stock supplied to a cigarette making machine or added to a tobacco column prior to wrapping cigarette paper around the tobacco column.

The supported or unsupported clusters may be provided in the form of a dry powder, as a dispersion in a liquid or as a paste. Supported or unsupported clusters in the form of a dry powder can be dusted on or combined with the cut filler tobacco, cigarette paper or filter material. For example, clusters can be added to the paper stock of a cigarette paper making machine. Clusters can be incorporated into cigarette paper and/or into the raw materials used to make cigarette paper. The transition metal oxide clusters may be present in the form of a dispersion and sprayed on the cut filler tobacco, cigarette paper and/or cigarette filter material. The tobacco cut filler, cigarette paper or cigarette filter material may be rinsed or dip-coated with a liquid containing the clusters.

The amount of the transition metal oxide clusters incorporated into a smoking article can be selected such that the amount of carbon monoxide in mainstream smoke is reduced during smoking of a cigarette.

According to an embodiment, supported or unsupported transition metal oxide clusters can be prepared and then incorporated into a component of a smoking article. According to a further embodiment, a method is provided for forming and depositing transition metal oxide clusters directly on smoking article components such as tobacco cut filler, cigarette paper and cigarette filter materials.

A preferred method of forming transition metal oxide clusters is physical vapor deposition (PVD). Physical vapor deposition can be used to form unsupported or supported transition metal oxide clusters. As a non-limiting example, transition metal oxide clusters can be formed by PVD, optionally combined with a support, and then incorporated in and/or on a smoking article component. As a further example, supported transition metal oxide clusters can be formed by PVD and then incorporated in and/or on a smoking article component. According to an embodiment, supported or unsupported transition metal oxide clusters can be formed and deposited in situ directly on a smoking article component by physical vapor deposition. The method comprises the steps of (i) supporting the component in a chamber having a target; (ii) bombarding the target with energetic ions to form transition metal oxide clusters; and (iii) depositing the transition metal oxide clusters on a surface of the component in order to incorporate the transition metal oxide clusters in and/or on the component.

Physical vapor deposition includes sputter deposition and laser ablation of a target material. With PVD processes, material from a source (or target) is removed from the target by physical erosion by ion bombardment and deposited on a surface of a substrate. The target is formed of (or coated with) a consumable material to be removed and deposited, i.e., target material. The target material may be any suitable precursor material with a preferred form being solid or powder materials composed of pure materials or a mixture of materials. Such materials are preferably solids at room temperature and/or not susceptible to chemical degradation such as oxidation in air.

Sputtering is conventionally implemented by creating a glow discharge plasma over the surface of the target material in a controlled pressure gas atmosphere. Energetic ions from the sputtering gas, usually a chemically inert noble gas such as argon, are accelerated by an electric field to bombard and eject atoms from the surface of the target material. By energetic ions is meant ions having sufficient energy to cause sputtering of the target material. The amount of energy required will vary depending on process variables such as the temperature of the target material, the pressure of the atmosphere surrounding the target material, and material properties such as the thermal and optical properties of the target material.

If the density of the ejected atoms is sufficiently low, and their relative velocities sufficiently high, atoms from the target material travel through the gas until they impact the surface of the substrate where they can coalesce into transition metal oxide clusters. If the density of the ejected atoms is sufficiently high, and their relative velocities sufficiently small, individual atoms from the target can aggregate in the gas phase into transition metal oxide clusters, which can then deposit on the substrate.

Without wishing to be bound by theory, at a sputtering pressure lower than about $10^{-4}$ Torr the mean free path of sputtered species is sufficiently long that sputter species arrive at the substrate without undergoing many gas phase collisions. Thus, at lower pressures, sputtered material can deposit on the substrate as individual species, which may diffuse and coalesce with each other to form transition metal oxide clusters after alighting on the substrate surface. At a higher pressures, such as pressures above about $10^{-4}$ Torr, the collision frequency in the gas phase of sputtered species is significantly higher and nucleation and growth of the sputtered species to form transition metal oxide clusters can occur in the gas phase before alighting on the substrate surface. Thus, at higher pressures, sputtered material can form transition metal oxide clusters in the gas phase, which can deposit on the substrate as discrete transition metal oxide clusters. Sputtered species, which can form a vapor, can be cooled via interaction with gases present within the chamber. Clusters form and can grow while losing heat to the surrounding gas and the walls of the chamber.

There are several different types of apparatus that can be used to generate a glow discharge plasma for sputtering. In a DC diode system, there are two electrodes. A positively charged anode supports the substrate and a negatively charged cathode comprises the target material. In the DC diode system, sputtering of the target is achieved by applying a DC potential across the two electrodes.

In a radio-frequency (RF) sputtering system, an AC voltage (rather than a DC voltage) is applied to the electrodes. Advantageously, an RF sputtering system can be used to sputter materials that form an insulating layer such as an insulating native oxide. In both DC and RF sputtering, most secondary electrons emitted from the target do not cause ionization events with the sputter gas but instead are collected at the anode. Because many electrons pass through the discharge region without creating ions, the sputtering rate of the target is lower than if more electrons were involved in ionizing collisions.

One known way to improve the efficiency of glow discharge sputtering is to use magnetic fields to confine electrons to the glow region in the vicinity of the cathode/target surface. This process is termed magnetron sputtering. The addition of such magnetic fields increases the rate of ionization. In magnetron sputtering systems, deposition rates greater than those achieved with DC and RF sputtering systems can be achieved by using magnetic fields to confine the electrons near the target surface.

Figure 6:
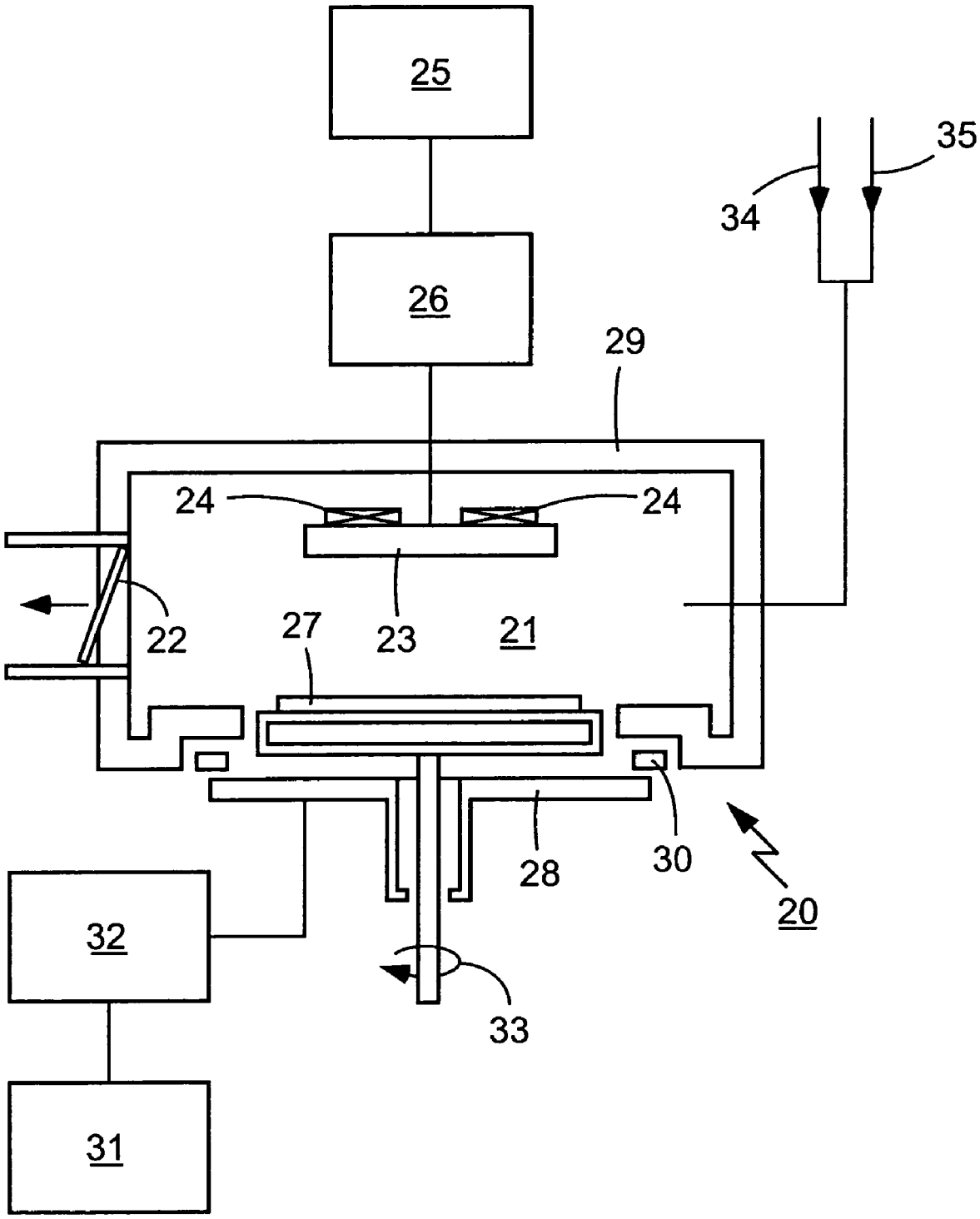
FIG. 6 is an illustration of a sputter deposition apparatus.

A method of forming and depositing transition metal oxide clusters via sputtering is provided in conjunction with the exemplary sputtering apparatus depicted in FIG. 6. Apparatus 20 includes a sputtering chamber 21 having an optional throttle valve 22 that separates the chamber 21 from an optional vacuum pump (not shown). A pressed powder target 23 such as an iron oxide target is mounted in chamber 21. Optional magnets 24 are located on the backside of target 23 to enhance plasma density during sputtering. The sputtering target 23 is electrically isolated from the housing 29 and electrically connected to a RF power supply 25 through an impedance matching device 26. A substrate 27 can be mounted on a substrate holder 28, which is electrically isolated from the housing 29 by a dielectric spacer 30. The housing 29 is maintained at a selected temperature such as room temperature. The substrate holder 28 can be RF biased for plasma cleaning using an RF power supply 31 connected through an impedance matching device 32. The substrate holder 28 can also be provided with rotation capability 33.

Referring still to FIG. 6, the reactor chamber 21 contains conduits 34 and 35 for introducing various gases. For example, argon could be introduced through conduit 34 and, optionally, oxygen through conduit 35. Gases are introduced into the chamber by first passing them through separate flow controllers to provide a total pressure of argon and oxygen in the chamber of greater than about $10^{-4}$ Torr.

In order to obtain a reactive sputtering plasma of the gas mixture, an RF power density of from about 0.01 to 10 W/cm$^2$ can be applied to the target 23 throughout the deposition process. Pressure in the chamber during physical vapor deposition can be between about $10^{-4}$ Torr to 760 Torr. The substrate temperature can be between about −196° C. and 100° C. A temperature gradient can be maintained between the target and the substrate during the deposition by flowing a cooling liquid such as chilled water or liquid nitrogen through the substrate support. In order to reduce condensation on the sidewalls of the chamber, the sidewalls can be heated, e.g., resistance heater wires surrounding the outer periphery of the sidewall can be used to heat the sidewall.

Transition metal oxide clusters can be formed and collected on a substrate 27, and then incorporated into a smoking article component such as tobacco cut filler, cigarette paper or tobacco filter material as described above. Alternatively, the substrate can comprise a component of a smoking article and the transition metal oxide clusters can be formed and simultaneously incorporated in and/or on the smoking article component.

As is well known in the art, energetic ions can also be provided in the form of an ion beam from an accelerator, ion separator or an ion gun. An ion beam may comprise inert gas ions such as neon, argon, krypton or xenon. Argon is preferred because it can provide a good sputter yield and is relatively inexpensive. The energy of the bombarding inert gas ion beam can be varied, but should be chosen to provide a sufficient sputtering yield. The ion beam can be scanned across the surface of the target material in order to improve the uniformity of target wear.

The introduction of reactive gases into the chamber during the deposition process allows material sputtered or ablated from the target to combine with such gases to obtain transition metal oxide clusters. Thus, in reactive PVD the sputtering gas includes a small proportion of an oxidizing gas, such as CO, $CO_2$, NO, $O_2$, water vapor and mixtures thereof, which react with the atoms of the target material to form metal oxide clusters. For example, iron oxide clusters can be deposited by sputtering an iron target in the presence of oxygen. Transition metal oxide clusters can be deposited on a substrate via the sputtering of the corresponding oxide target. For example, iron oxide clusters may be deposited by sputtering an iron oxide target.

The structure and composition of the transition metal oxide clusters can be controlled using physical vapor deposition. The particle size, ground state geometry and metal to oxygen ratio can be controlled by varying, for example, the deposition pressure, ion energy and substrate temperature.

According to an embodiment, transition metal oxide clusters and support particles are formed simultaneously to produce supported transition metal oxide clusters. Supported transition metal oxide clusters can be formed by sputtering or ablating a mixed or composite target. Such a target comprises at least first and second transition metal elements. A suitable target can comprise, for example, iron oxide and copper oxide in the form of a pressed pellet, which can be sputtered or ablated to form iron oxide clusters supported on support particles comprising copper oxide.

A preferred example of PVD is laser ablation. An apparatus for ablative processing includes a chamber in which a target material is placed. Typically, the chamber includes two horizontal metal plates separated by an insulating sidewall. An external energy source, such as a pulsed excimer laser, enters the chamber through a window, preferably quartz, and interacts with the target. Alternatively, the energy source can be internal, i.e., positioned inside the chamber.

Preferably a temperature gradient is maintained between the top and bottom plates, which can create a steady convection current that can be enhanced by using a heavy gas such as argon and/or by using above atmospheric pressure conditions in the chamber (e.g., above about $1\times10^3$ Torr). The steady convection current can be achieved in two ways; either the bottom plate is cooled such as by circulating liquid nitrogen and the top plate is kept at a higher temperature (e.g., room temperature) or the top plate is heated such as by circulating heating fluid and the bottom plate is kept at a lower temperature (e.g., room temperature). In either case, the bottom plate is kept at a temperature significantly lower than the top plate, which makes the bottom plate the condensation or deposition plate. Preferably a temperature gradient of at least 20° C., more preferably at least 50° C., is maintained between the top plate and the bottom during the deposition. Convection with the chamber may be enhanced by increasing the temperature gradient or by using a heavier carrier gas (e.g., argon as compared to helium). Details of a suitable chamber can be found in The Journal of Chemical Physics, Vol. 52, No. 9, May 1, 1970, pp. 4733-4748, the disclosure of which is hereby incorporated by reference.

In an ablative process, a region of the target absorbs incident energy from the energy source. This absorption and subsequent heating of the target causes target material to ablate from the surface of the target into a plume of atomic and nanometer-scale particles. Laser energy preferably vaporizes the target directly, without the target material undergoing significant liquid phase transformations. Laser vaporization produces a high-density vapor within a very short time, typically $10^{-8}$ sec, in a directional jet that allows directed deposition. The particles ejected from the target undergo Brownian motion during the gas-to-cluster conversion. The ablated species, which are cooled by the carrier gas, can reach a high degree of supersaturation and can condense to form transition metal oxide clusters. The higher the supersaturation, the smaller will be the size of the nucleus required for condensation in the gas phase. Changing the temperature gradient may enhance the supersaturation in the chamber. The ablated species can condense in the gas phase and/or after alighting on the surface of a substrate. Clusters having different stoichiometries (e.g., different metal/oxygen ratios) can be obtained under different ablation conditions.

Clusters of metal oxides can be prepared by laser ablation of metal or metal oxide targets into a carrier gas flow in the presence of an optional oxidizer gas. The reaction chamber is connected to a gas supply. The carrier gas can comprise an inert gas such as He, Ar or mixtures thereof. The optional oxidizer gas can comprise an oxygen-containing gas such as CO, $CO_2$, NO, $O_2$, $H_2O$ or mixtures thereof.

In an embodiment, transition metal oxide clusters may be formed by a physical vapor deposition process such as laser ablation, collected, and incorporated into a component of a smoking article. In another embodiment, transition metal oxide clusters may be simultaneously formed and incorporated in and/or on a component of a smoking article using a physical vapor deposition process such as laser ablation. Advantageously, ablation such as laser ablation can be performed at or above atmospheric pressure without the need for vacuum equipment. Thus, the transition metal oxide clusters may be simultaneously formed and deposited on a component of a smoking article that is maintained at ambient temperature and atmospheric pressure during the deposition process. The smoking article material may be supported on a substrate holder or, because a laser ablation process can be carried out at atmospheric pressure, passed through the coating chamber on a moving substrate holder such as a conveyor belt operated continuously or discontinuously to incorporate the desired amount of deposited transition metal oxide clusters in and/or on the smoking article component.

Lasers include, but are not limited to, Nd-YAG lasers, ion lasers, diode array lasers and pulsed excimer lasers. Laser energy may be provided by the second harmonic of a pulsed Nd-YAG laser at 532 nm with 15-40 mJ/pulse. In a preferred embodiment, the vapor can be generated in the chamber by pulsed laser vaporization using the second harmonic (532 nm) (optionally combined with the fundamental (1064 nm)) of a Nd-YAG laser (50-100 mJ/pulse, $10^{-8}$ second pulse). The laser beam can be scanned across the surface of the target material in order to improve the uniformity of target wear by erosion.

As discussed above, with sputtering a substrate is typically placed proximate to the cathode. With sputtering and ablative processes, the substrate is preferably placed within sputtering proximity of the target, such that it is in the path of the sputtered or ablated target atoms and the target material is deposited on the surface of the substrate.

By regulating the deposition parameters, including background gas, pressure, substrate temperature and time, it is possible to prepare cigarette components such as tobacco cut filler, cigarette paper and/or cigarette filter material that comprise a loading and distribution of supported or unsupported transition metal oxide clusters effective to reduce the amount of carbon monoxide in mainstream smoke.

Preferably, the amount of the clusters will be a catalytically effective amount. Preferably, the transition metal oxide clusters are incorporated in a cigarette in an amount effective to reduce the ratio in mainstream smoke of carbon monoxide to total particulate matter (e.g., tar) by at least 10% (e.g, by at least 15%, 20%, 25%, 30%, 35%, 40% or 45%). Preferably, the transition metal oxide clusters comprise less than about 10% by weight of the smoking article component, more preferably less than about 5% by weight of the smoking article component. Preferably, the transition metal oxide clusters comprise less than about 10% by weight of the cigarette, more preferably less than about 5% by weight of the cigarette.

When forming and depositing transition metal oxide clusters directly on a smoking article component, the PVD process is stopped when there is still exposed surface of the smoking article component. That is, the PVD method does not build up a continuous layer but rather forms discrete clusters that are distributed over the component surface. During the process, new clusters can form and existing clusters can grow. Advantageously, physical vapor deposition allows for dry, solvent-free, simultaneous formation and deposition of transition metal oxide clusters under sterile conditions.

One embodiment provides tobacco cut filler, cigarette paper or cigarette filter material that comprise transition metal oxide clusters. Any suitable tobacco mixture may be used for the cut filler. Examples of suitable types of tobacco materials include flue-cured, Burley, Md. or Oriental tobaccos, the rare or specialty tobaccos, and blends thereof. The tobacco material can be provided in the form of tobacco lamina, processed tobacco materials such as volume expanded or puffed tobacco, processed tobacco stems such as cut-rolled or cut-puffed stems, reconstituted tobacco materials, or blends thereof. The tobacco can also include tobacco substitutes.

In cigarette manufacture, the tobacco is normally employed in the form of cut filler, i.e., in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g., burn additives, combustion modifying agents, coloring agents, binders, etc.) known in the art.

A further embodiment provides a cigarette comprising a tobacco rod, cigarette paper and an optional filter, wherein at least one of the tobacco rod, cigarette paper and optional filter comprise clusters of transition metal oxides. A still further embodiment relates to a method of making a cigarette, wherein the transition metal oxide clusters are incorporated in and/or on at least one of tobacco cut filler and cigarette paper, which are provided to a cigarette making machine and formed into a cigarette. The cigarette may comprise an optional filter that comprises transition metal oxide clusters.

Techniques for cigarette manufacture are known in the art. Any conventional or modified cigarette making technique may be used to incorporate the clusters. The resulting cigarettes can be manufactured to any known specifications using standard or modified cigarette making techniques and equipment. Typically, the cut filler composition is optionally combined with other cigarette additives, and provided to a cigarette making machine to produce a tobacco column, which is then wrapped in cigarette paper to form a tobacco rod which is cut into sections, and optionally tipped with filters. Transition metal oxide clusters incorporated into cigarette filter material can adsorb carbon monoxide.

Cigarettes may range from about 50 mm to about 120 mm in length. The circumference is from about 15 mm to about 30 mm in circumference, and preferably around 25 mm. The tobacco packing density is typically between the range of about 100 mg/cm$^3$ to about 300 mg/cm$^3$, and preferably 150 mg/cm$^3$ to about 275 mg/cm$^3$.

While various embodiments have been described, it is to be understood that variations and modifications may be resorted to as will be apparent to those skilled in the art. Such variations and modifications are to be considered within the purview and scope of the claims appended hereto.

All of the above-mentioned references are herein incorporated by reference in their entirety to the same extent as if each individual reference was specifically and individually indicated to be incorporated herein by reference in its entirety.

What is claimed is:

1. A process for forming transition metal oxide clusters comprising:

forming a suspension of a metal oxide precursor and a template material in an organic solvent, wherein the metal oxide precursor comprises a first metal;

heating the suspension in a sealed chamber to a temperature and pressure, wherein the temperature and pressure are less than the critical temperature and pressure, respectively, of the liquid medium;

cooling the liquid medium to room temperature and reducing the pressure of the liquid medium to atmospheric pressure;

drying the suspension to form transition metal oxide clusters; and treating the suspension to remove the template material from the clusters.

2. The method of claim 1, wherein the template material comprises carbon nanotubes, long chain alkyl amines or polymer molds and/or fibers.

3. The method of claim 1, wherein the metal oxide precursor comprises iron.

4. The method of claim 1, wherein the template material is removed from the clusters by a chemical or thermal process.

5. The method of claim 1, wherein the suspension is heated to a temperature greater than about 200° C. and a pressure greater than about 100 MPa.

* * * * *